US007971652B2

(12) United States Patent
Tanju

(10) Patent No.: US 7,971,652 B2
(45) Date of Patent: Jul. 5, 2011

(54) LINEAR ACTUATION SYSTEM IN THE FORM OF A RING

(75) Inventor: Baha Tulu Tanju, Humble, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 144 days.

(21) Appl. No.: 12/262,769

(22) Filed: Oct. 31, 2008

(65) Prior Publication Data

US 2010/0108324 A1 May 6, 2010

(51) Int. Cl.
*E21B 34/12* (2006.01)
*F16K 31/02* (2006.01)

(52) U.S. Cl. ..... 166/373; 166/66.7; 166/332.2; 166/332.8; 254/100; 254/DIG. 8; 251/129.11; 251/339

(58) Field of Classification Search ..... 166/332.1, 166/332.2, 332.8, 334.1, 66.5, 65.1, 65.6, 166/65.7, 66.7; 251/77, 129.11, 264, 339, 251/267; 254/98, DIG. 8, 100
See application file for complete search history.

(56) References Cited

U.S. PATENT DOCUMENTS 4,161,219 A 7/1979 Pringle
6,321,845 B1 11/2001 Deaton
6,478,090 B2 11/2002 Deaton
6,955,187 B1 * 10/2005 Johnson ..... 137/625.33
7,170,214 B2 * 1/2007 Henderson et al. ..... 310/323.02
7,373,972 B2 * 5/2008 Ocalan ..... 166/66.7
2004/0173362 A1 9/2004 Waithman et al.
2005/0230118 A1 10/2005 Noske et al.
2006/0175052 A1 * 8/2006 Tips ..... 166/53
2007/0289734 A1 * 12/2007 McDonald et al. ..... 166/66.5
2008/0157014 A1 * 7/2008 Vick et al. ..... 251/65

OTHER PUBLICATIONS

International Search Report from PCT/US2009/062678, mailed May 17, 2010.

* cited by examiner

*Primary Examiner* — Kenneth Thompson
(74) *Attorney, Agent, or Firm* — Merchant & Gould

(57) ABSTRACT

A device for use in actuating a valve to control the flow of fluids through a flow tube comprises a stationary ring surrounding the flow tube, the ring having an inner diameter greater than an outer diameter of the flow tube. An interior of the ring and an exterior of the flow tube have complementary screw threads. At least three actuators are equally circumferentially spaced along an exterior of the ring. When activated an actuator induces a screw thread on the interior of the ring to engage a screw thread on the exterior of the flow tube such that the flow tube is moved in an axial direction relative to the ring.

22 Claims, 8 Drawing Sheets

LINEAR ACTUATION SYSTEM IN THE FORM OF A RING

FIELD

The present disclosure relates to valves, such as subsurface safety valves, that are adapted for downhole use in controlling fluid flow in tubing or conduit disposed in a wellbore penetrating subsurface strata. In an embodiment, the present disclosure relates to the actuation of such valves in wellbores that are characterized by high temperatures and high pressures.

BACKGROUND

Various types of valve apparatus are used in various wellbore types (e.g., subsea, platform, land-based) to control fluid flow through tubing or conduits disposed therein. One such valve is referred to as a subsurface safety valve, or simply as a safety valve, and it provides a "fail-safe" mechanism for closing the wellbore to prevent the uncontrolled release of hydrocarbons or other downhole fluids. Such safety valves are typically actuated in emergency situations, such as blowouts, to provide a pressure barrier (oftentimes in cooperation with blowout preventers) and safeguard local personnel, equipment, and the environment.

U.S. Pat. No. 4,161,219 discloses a safety valve configuration that employs a flapper valve that is spring-biased towards a position closing a fluid passageway in the safety valve body, and a flow tube that is movable between a first position yielding the biasing spring of the flapper valve to open the flapper valve and a second position permitting the biasing spring of the flapper valve to close the flapper valve. The flow tube is also spring biased towards the second position that releases the flapper valve, but the flow tube is normally urged towards the first position in which the flapper valve is opened by the application of hydraulic fluid pressure from the surface. In the event of an emergency, such as a blowout, the hydraulic fluid pressure is reduced to permit the spring bias of the flow tube to urge the flow tube towards its second position, thereby releasing the flapper valve so that its biasing spring urges the flapper valve towards the position closing the fluid passageway.

It is commonly believed today that most of the remaining oil and gas reserves of considerable substance are located in so-called "deep water" or "ultra-deep water" subsurface formations. Such formations may lie underneath 7,000 feet or more of water and up to 30,000 feet or more beneath the seafloor. Some industry experts predict that by the year 2015, 25% or more of offshore oil production will be sourced from deepwater wellbores. As deepwater wells are drilled to greater depths, they begin to encounter extreme high pressure, high temperature conditions (i.e., having an initial reservoir pressure greater than approximately 10 kpsi (69 Mpa) or reservoir temperature greater than approximately 300° F. (149° C.)) that constitute one of the greatest technical challenges facing the oil and gas industry today. As a result, materials that have been used for many years now face unique and critical environmental conditions for which they may not be suitable.

A clear example of such material challenges is found in hydraulic fluids, which are used in a number of downhole applications including safety valve actuation as described above. Hydraulic fluids will suffer a breakdown or stagnation when exposed to high temperatures over time (safety valves can sit dormant downhole for decades) that severely compromises the hydraulic properties of such fluids, rendering them incapable of functioning for their intended hydraulic purposes. Additionally, hydraulically-actuated safety valves are subject to seal failure over time that reduces their performance and reliability.

Therefore, a need exists for a means of reliably actuating valves such as safety valves in downhole environments, for example, in the high pressure, high temperature environments of deepwater wellbores.

SUMMARY

The above-described needs, problems, and deficiencies in the art, as well as others, are addressed by the present disclosure in its various aspects and embodiments. Provided is a device for use in actuating a valve to control the flow of fluids through a flow tube. The device comprises a stationary ring surrounding the flow tube, the ring having an inner diameter greater than an outer diameter of the flow tube. An interior of the ring and an exterior of the flow tube have complementary screw threads. At least three actuators are equally circumferentially spaced along an exterior of the ring. When activated, an actuator induces a screw thread on the interior of the ring to engage a screw thread on the exterior of the flow tube such that the flow tube is moved in an axial direction relative to the ring so as to induce movement of the valve from a closing position to an opening position.

Advantages of the presently disclosed linear actuation system in the form of a ring include minimization of power consumption for the linear actuation system, as well as the ability of the device to be used in a tight annulus space between two tubular shapes.

BRIEF DESCRIPTION OF THE DRAWINGS

So that the above recited features and advantages of the present disclosure can be understood in detail, a more particular description of the summary above may be had by reference to the embodiments thereof that are illustrated in the appended drawings. It is to be noted, however, that the appended drawings illustrate only typical embodiments and are therefore not to be considered limiting, for the present disclosure may admit to other equally effective embodiments.

DETAILED DESCRIPTION

Figure 1D:
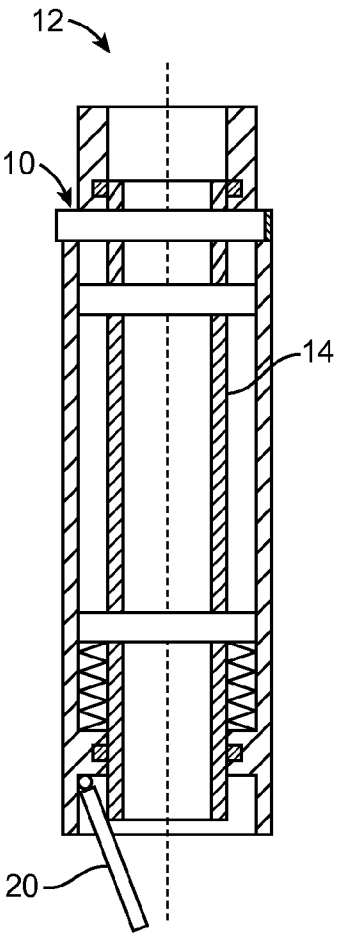
FIGS. 1A-1D are sequential sectional views, in elevation, of a subsurface safety valve being actuated between closed and opened positions via linear actuation via the presently disclosed linear actuation system in the form of a ring.
Figure 1C:
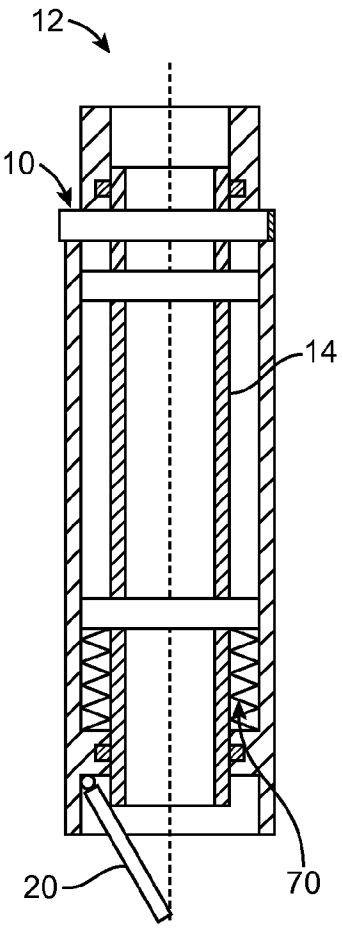
Figure 1B:
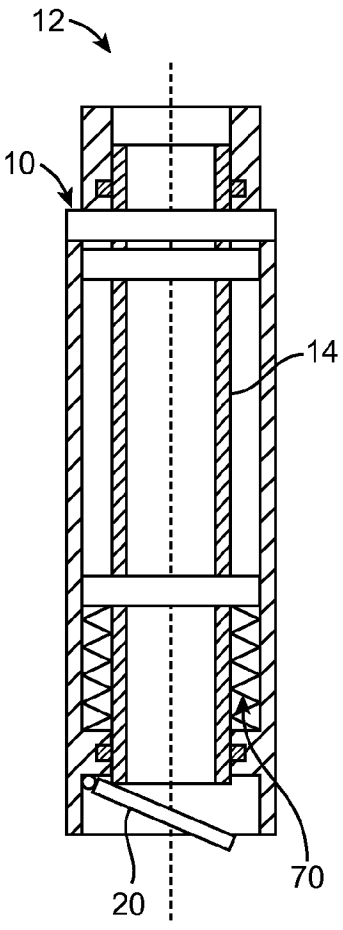
Figure 1A:
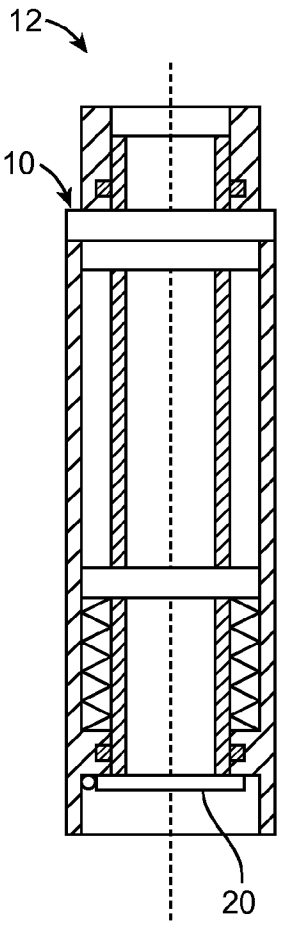

FIGS. 1A-1D are sequential sectional views, in elevation, of a subsurface safety valve being actuated between closed and opened positions via linear actuation via the presently disclosed linear actuation system in the form of a ring. In particular, FIG. 1A shows the subsurface safety valve 12 in a closed position, while FIGS. 1B-1D show the subsurface safety valve 12 opening. As shown in FIGS. 1B-1D, an inner drive sleeve (or flow tube) 14 of the valve 12, is forced towards a flapper 20 of the valve 12 by the ring 10 and opens the flapper (with increasing degrees of opening of the flapper illustrated in series in FIGS. 1B, 1C, and 1D). Movement of the drive sleeve 14 towards the flapper 20, and concomitant opening of the flapper, can be opposed by one or more fail-safe springs 70.

Figure 2B:
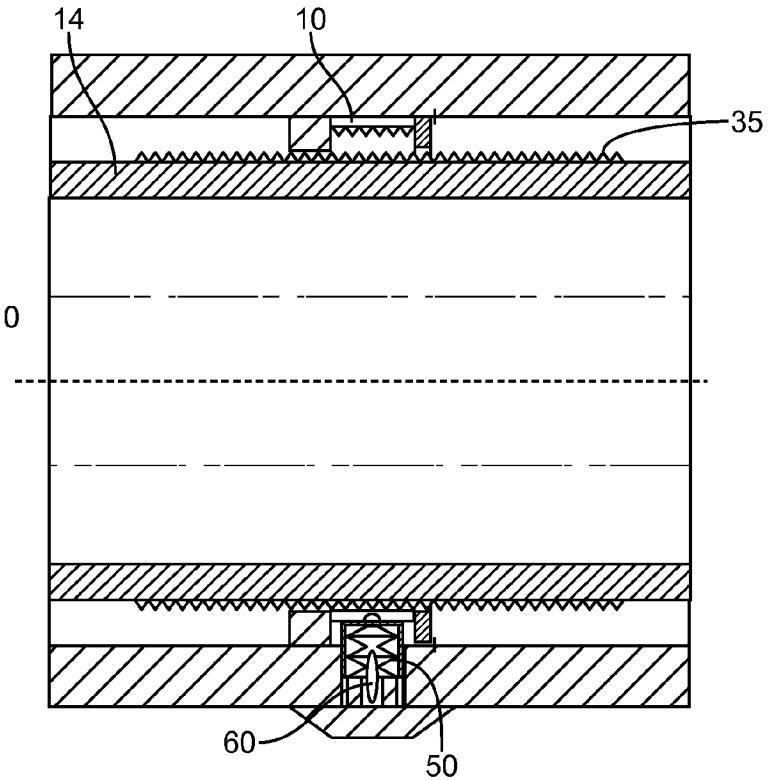
FIG. 2A is a cross-sectional view and FIG. 2B is a corresponding partially sectioned, elevational view of an embodiment of the presently disclosed linear actuation system in the form of a ring.
Figure 2A:
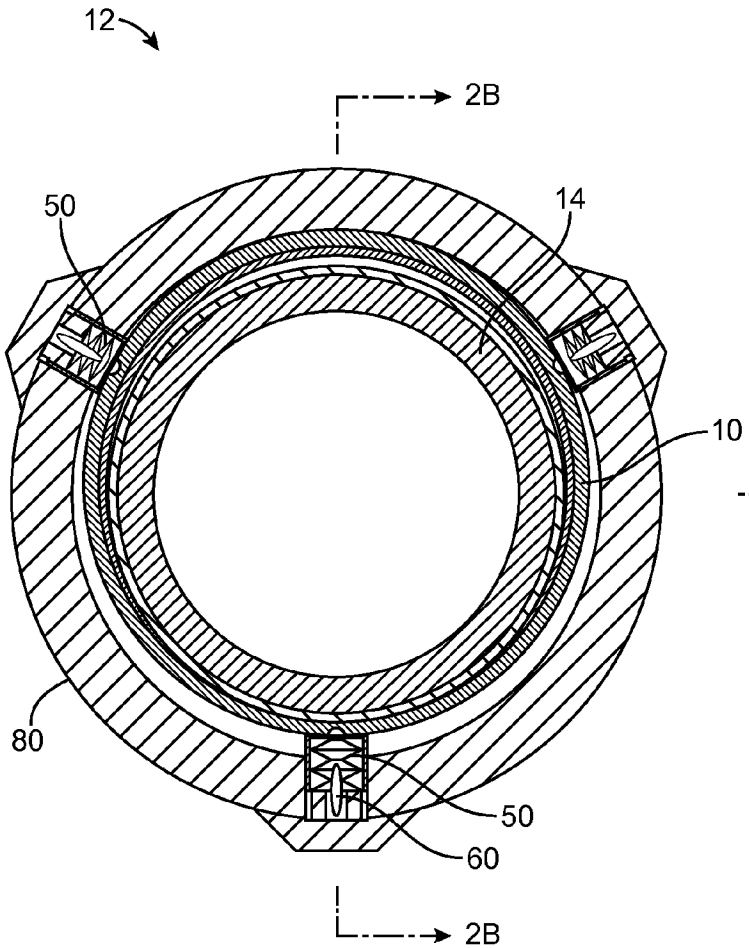

FIG. 2A is a cross-sectional view and FIG. 2B is a corresponding partially sectioned, elevational view of a linear actuation system, in the form of a ring 10, that may be utilized to actuate a subsurface safety valve (e.g., an electric surface controlled subsurface safety valve) 12. The device can be used in a tight annulus space between two tubular shapes, for example, the space between a flow tube 14 and the body 80 of a downhole valve 12.

The device works similar to an oversized nut advancing along the length of a rotationally fixed bolt (assuming thread pitches are the same for the nut and bolt), wherein the bolt moves in an axial direction with respect to the nut. Likewise, when an oversized internally threaded ring 10 advances along the length of a rotationally fixed, externally threaded flow tube 14, the flow tube 14 moves in axial direction with respect to the ring 10. By "oversized", it is meant that a minimum internal diameter of the internally threaded ring 10 is larger than a maximum external diameter of the externally threaded flow tube 14, the flow tube comprising external threads 35.

The axial direction in which flow tube 14 moves depends on the thread and the direction of movement of the ring 10. If the direction of movement of the ring 10 is reversed, the direction of movement of the flow tube 14 is reversed.

The flow tube 14 may be advanced through the ring 10 to open the valve by multiple (e.g., three, as shown in FIG. 2) shape memory alloy stacked conical washer type actuators 50, 50', circumferentially placed, and equally spaced around the ring 10. The actuators 50, 50' are heated by heating elements 60. The tendency of the ring 10 to rotate while the flow tube 14 is advanced through the ring 10 to open the valve is eliminated by the semi-spherical extensions on the actuators and oversized indentations on the ring 10.

The shape memory alloy may be an ultra-high temperature shape memory alloy, which refers to a shape memory alloy whose phase change range starts at 300° F. and higher, in comparison to a "conventional" shape memory alloy whose phase change range is approximately 122° F. to 194° F. Examples of ultra-high temperature shape memory alloys include NiTiPd and NiTiPt. Also contemplated are the use of cascading (ultra-high temperature) shape memory alloy elements, which refers to multiple wire-shaped (ultra-high temperature) shape memory alloy elements linked in a serial mechanical connection that combines the stroke displacement of the individual (ultra-high temperature) shape memory alloy elements in additive fashion to achieve a relatively long output stroke. Thus, the individual (ultra-high temperature) shape memory alloy elements may be assembled in a small length/space, but provide a cumulative maximum stroke displacement. In other embodiments, rather than comprising shape memory alloy elements, the actuators can comprise one or more hydraulic elements and/or one or more magnetic elements.

Figure 3B:
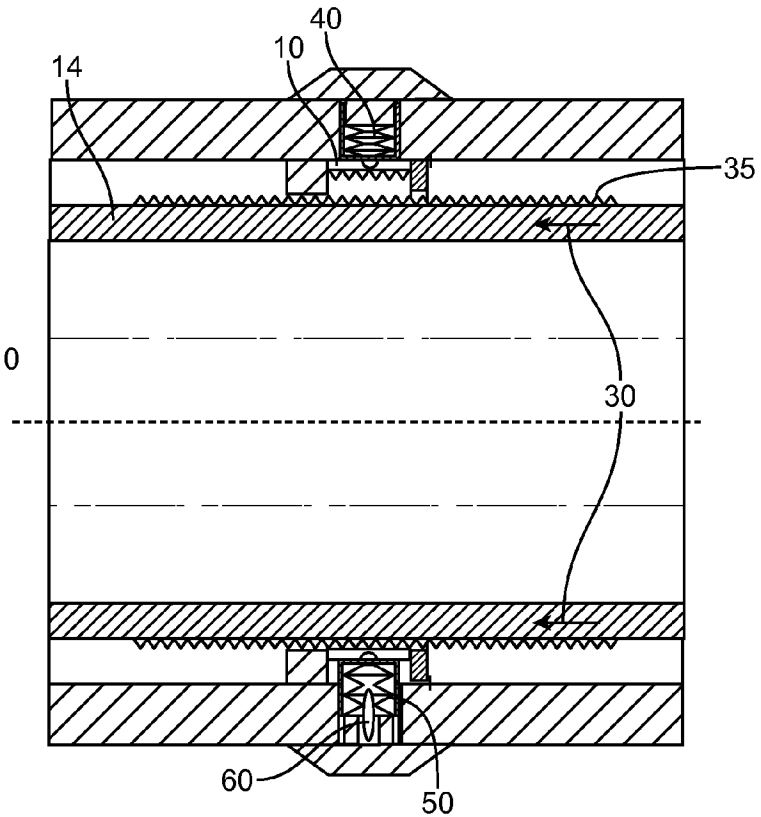
FIG. 3A is a cross-sectional view and FIG. 3B is a corresponding partially sectioned, elevational view of an embodiment of the presently disclosed linear actuation system in the form of a ring.
Figure 3A:
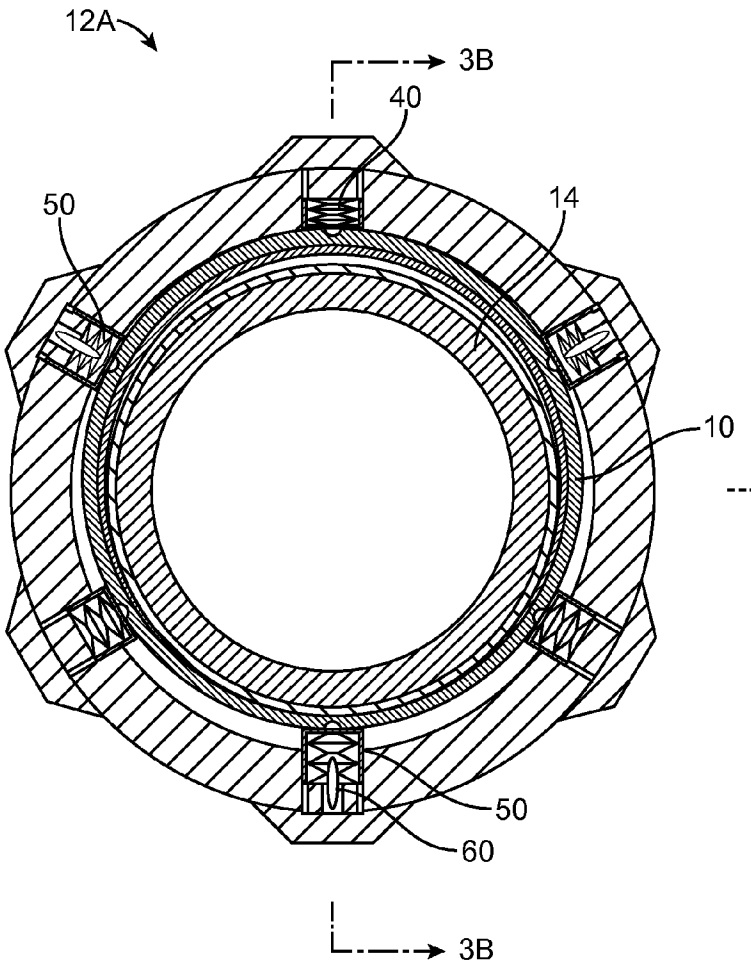

As illustrated in FIGS. 3A and 3B , the device can further include multiple (e.g., three, as shown in FIGS. 3A and 3B) centering springs 40 also circumferentially and equally spaced around the ring 10. When none of the multiple actuators are energized (50 representing an activated actuator and 50' representing a deactivated actuator), the centering springs 40 center the ring 10 about the flow tube 14 such that the threading on the interior of the ring 10 is not engaged with the threading 35 on the exterior of the flow tube 14, causing one or more fail-safe springs 70 to push the flow tube 14 into the closed position and close the safety valve 12A. In an embodiment, the ring 10 moves the flow tube 14 only in one direction, i.e., in a direction to open the valve 12A, against the force 30 of a fail-safe spring 70 of the valve 12A.

Figure 4:
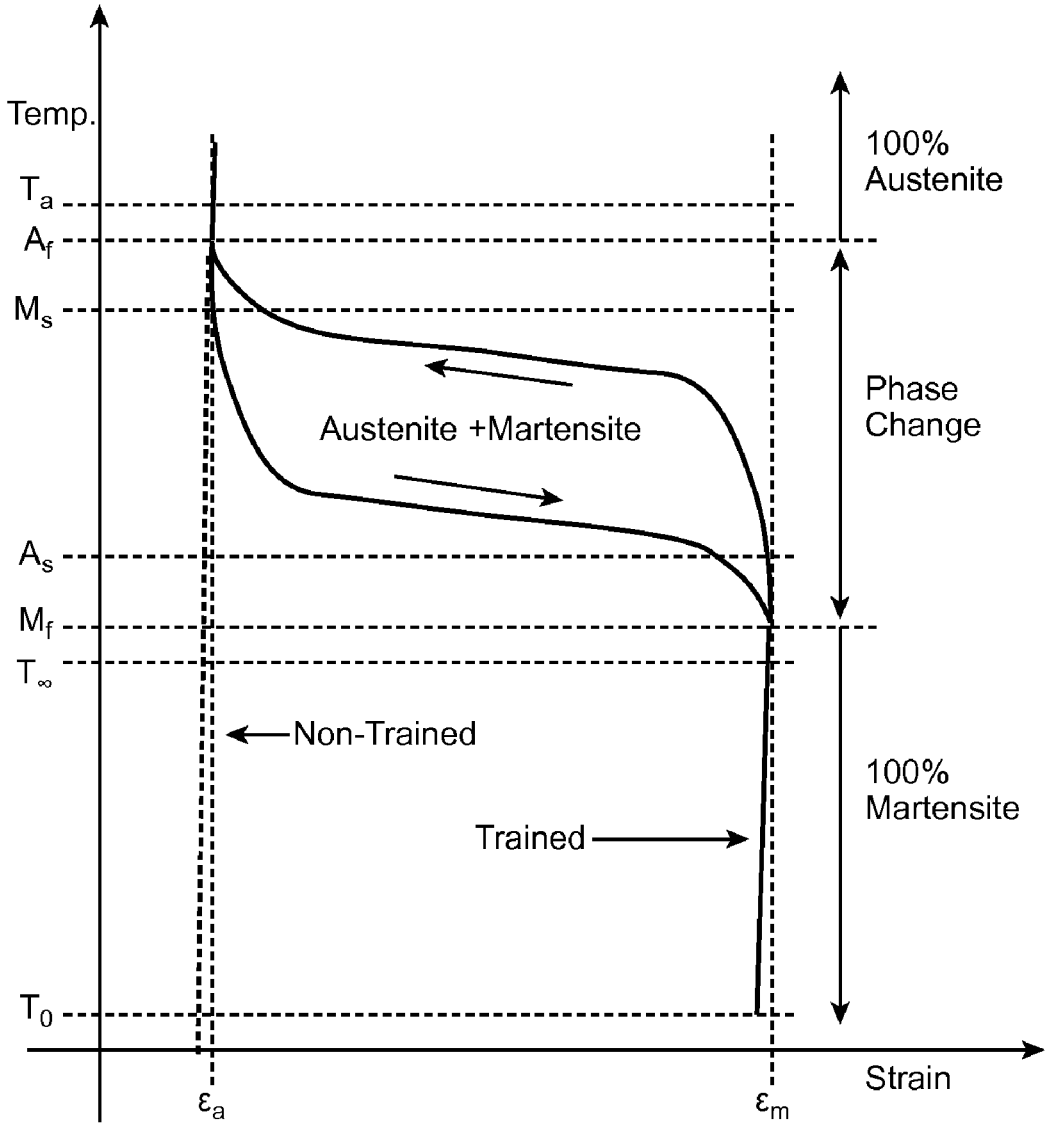
FIG. 4 is a temperature versus strain plot for shape memory alloy elements demonstrating the hysteresis of the temperature behavior for shape memory alloys in transition between martensite and austenite phases without mechanical loading.

FIG. 4 is a temperature versus strain plot for shape memory alloy elements demonstrating the hysteresis of the temperature behavior for shape memory alloys in transition between martensite and austenite phases without mechanical loading. In particular, $\epsilon_m$ is the theoretical maximum strain of trained shape memory alloy in martensite phase, $\epsilon_a$ is the theoretical maximum strain of trained shape memory alloy in austenite phase, $A_s$ is the theoretical temperature that first austenite crystal structure appears, $A_f$ is the theoretical temperature that all crystal structure became austenite, $M_s$ is the theoretical temperature that first martensite crystal structure appears, $M_f$ is the theoretical temperature that all crystal structure became martensite, $T_\infty$ is the working environment temperature, and $T_0$ is a temperature (significantly) lower than $T_\infty$, wherein $T_0<T_\infty \leqq M_f<A_s<M_s<A_f \leqq T_a$.

Some metal alloys (i.e., shape memory alloys) are "trainable" (i.e., can leave reminders of a deformed low-temperature condition in high-temperature phases) and exhibit a phase change while-in-solid-form. One or more noble metals (e.g., palladium) can be added to such shape memory alloys (e.g., nickel-titanium alloy) in order to achieve an ultra-high temperature shape memory alloy.

As shown in FIGS. 5A, 5B, 5C and 5D which are schematics of crystal structures with major material properties for shape memory alloys, wire-shaped shape memory alloys are trained by applying certain repeated tension at alloy specific temperatures. When a trained shape memory alloy wire is heated to phase change temperature, the shape memory alloy wire aggressively contracts until the end of phase change, contrary to conventional expectations.

Figures 5A, 5B, 5C, 5D:
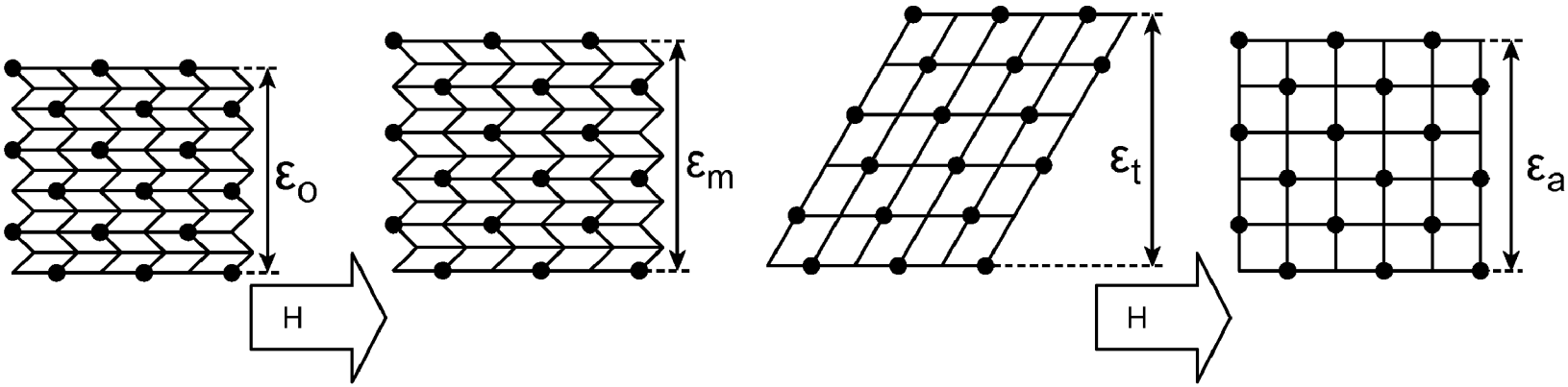
FIGS. 5A, 5B, 5C and 5D are schematics of crystal structures with major material properties for shape memory alloys.

In particular, FIG. 5 (FIGS. 5A-5D) shows phase change and the effect of training on strain with variation in temperature without mechanical loading. FIG. 5A shows a non-trained 100% martensite phase at temperature $=T_0$ exhibiting strain $\epsilon_0$. After application of heat (H), FIG. 5B shows a non-trained 100% martensite phase (twinned martensite; twinning occurs when two separate crystals share some of the same crystal lattice points in a symmetrical manner) at temperature $=T_\infty$ exhibiting strain $\epsilon_m$. FIG. 5C shows a trained 100% martensite phase (de-twinned martensite) at temperature $=T_\infty$ exhibiting strain $\epsilon_t$. After application of heat (H), FIG. 5D shows a 100% austenite phase at temperature $=T_a$ exhibiting strain $\epsilon_a$. Additionally, $T_0<T_\infty \leqq M_f<A_S<M_S<A_f \leqq T_a$; $\epsilon_0<\epsilon_m<\epsilon_t$; and $\epsilon_a<\epsilon_t$.

Figure 6B:
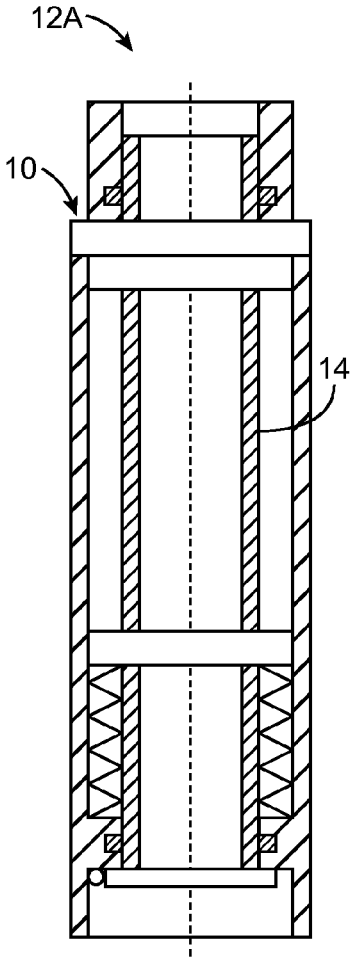
FIGS. 6B, 6D, 6F and 6H are sequential sectional views, in elevation.
Figure 6D:
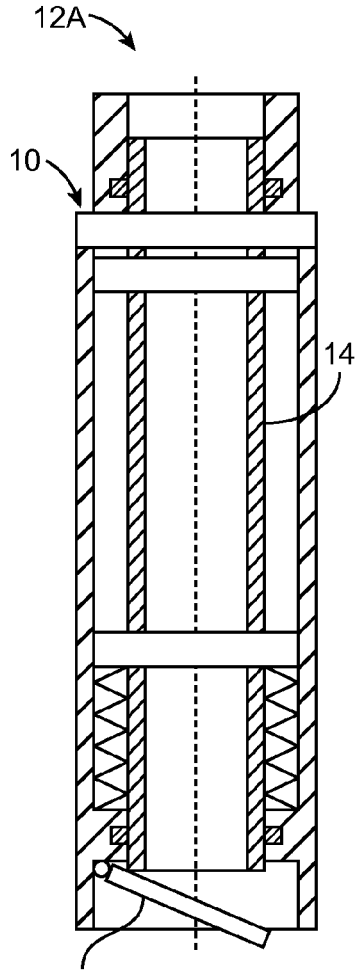
Figure 6A:
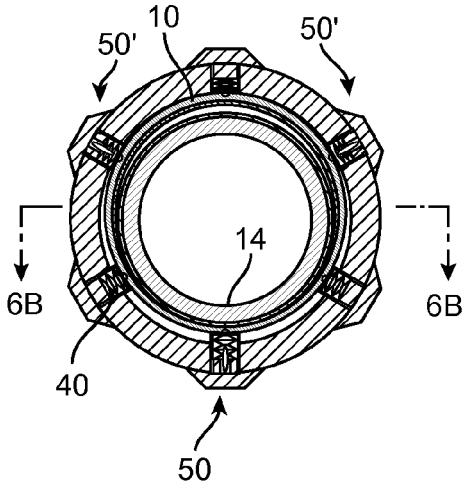
FIGS. 6A, 6C, 6E and 6G are cross-sectional views of a respective subsurface safety valve being actuated between closed and opened positions via the presently disclosed linear actuation system in the form of a ring.
Figure 6C:
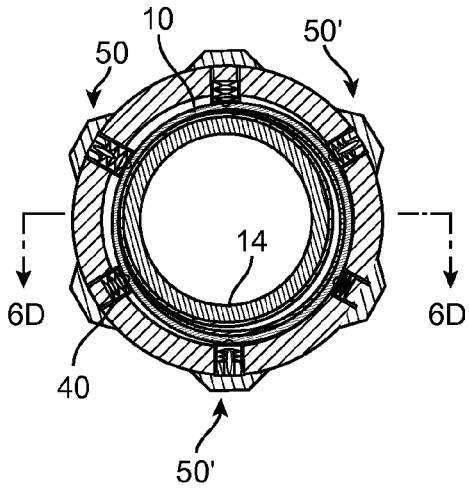
Figure 6F:
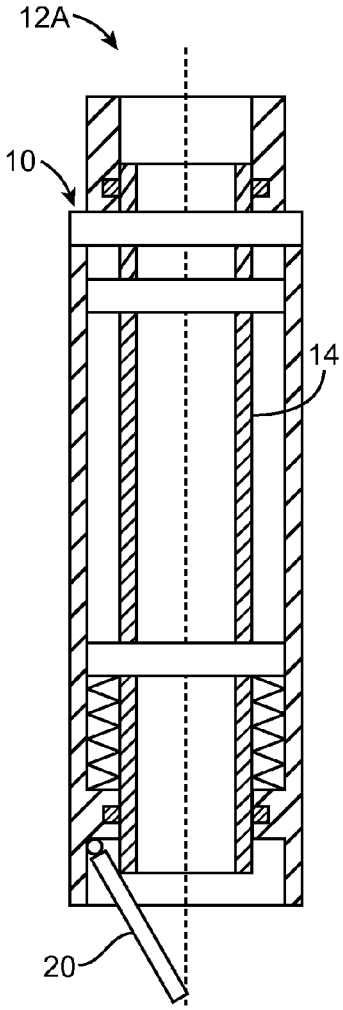
Figure 6H:
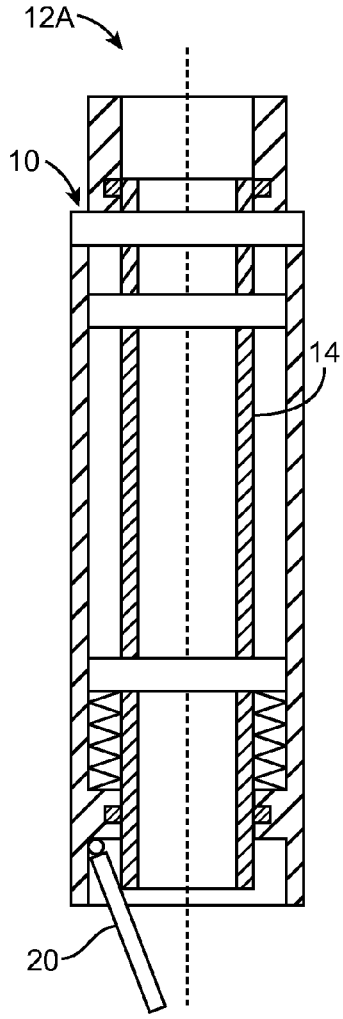
Figure 6E:
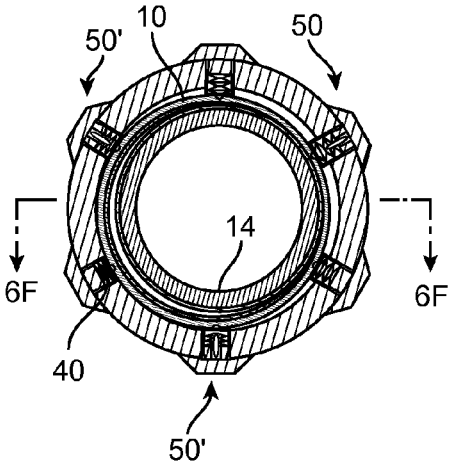
Figure 6G:
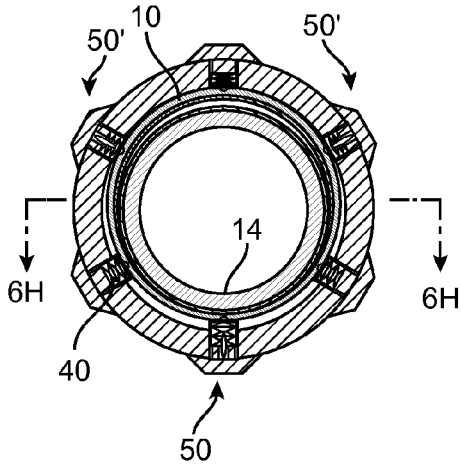

Similar to FIGS. 1A-1D, FIGS. 6B, 6D, 6F and 6H are sequential sectional views, in elevation, and FIGS. 6A, 6C, 6E and 6G are cross-sectional views of a subsurface safety valve 12A being actuated between closed and opened positions via linear actuation via the presently disclosed linear actuation system in the form of a ring. In particular, FIGS. 6A and 6B show the subsurface safety valve 12A in a closed position, with two deactivated actuators 50' and one activated actuator 50. The actuator 50 activated in FIG. 6A is hereby designated the 0° actuator (i.e., located at a 0° position), while the deactivated actuators 50' are designated the 120° and 240° actuators (i.e., located at 120° and 240° positions, respectively). FIGS. 6C-6H show the subsurface safety valve 12A opening by way of sequentially activating and deactivating the actuators 50, 50' (e.g., in a clockwise direction) so as to move the flow tube 14 in an axial direction towards the flapper 20 of the valve. In FIG. 6C, the 120° actuator 50 is activated, while the 240° and 0° actuators 50' are deactivated. Because the interior of the ring 10 and the exterior of the flow tube 14 have complementary screw threads, the flow tube is moved in a desired direction by sequentially activating and deactivating the actuators. In FIG. 6E, the 240° actuator 50 is activated, while the 0° and 120° actuators 50' are deactivated, while in FIG. 6G the 0° actuator 50 is activated, while the 120° and 240° actuators 50' are deactivated. Reversal of the order of sequentially activating and deactivating the actuators 50, 50' (i.e., FIG. G to FIG. 6E to FIG. 6C to FIG. 6A) would return the valve 12A to a closing position. Sequential activation and deactivation of the actuators 50, 50', and resultant movement of the flow tube 14, is made more smooth by the forces centering the ring 10 around the flow tube provided by the centering springs 40.

Accordingly, provided is a device for use in actuating a valve 12A to control the flow of fluids through a flow tube 14. The device comprises a stationary ring 10 surrounding the flow tube 14, the ring having an inner diameter greater than an outer diameter of the flow tube. An interior of the ring 10 and an exterior of the flow tube 14 have complementary screw threads. At least three actuators 50, 50' are equally circumferentially spaced along an exterior of the ring 10. When activated an actuator 50 induces a screw thread on the interior of the ring 10 to engage a screw thread 35 on the exterior of the flow tube 14 such that the flow tube is moved in an axial direction relative to the ring to induce movement of the valve 12A from a closing position to an opening position.

Centering springs 40 can be equally circumferentially spaced along an exterior of the ring 10. When none of the actuators 50' are activated, the centering springs 40 center the ring 10 about the flow tube 14, and a screw thread on the interior of the ring 10 is not engaged with a screw thread 35 on the exterior of the flow tube.

The device can further comprise a control line for conducting energy (e.g., heat energy) to the shape memory alloy elements. The control line can comprise one or more electrically conductive pathways for conducting electrical current across the shape memory alloy elements. The energy can be provided via an electrical supply selected from a group comprising AC, DC and high voltage pulse width modulation.

Thus, a method of opening a valve 12A using the ring device comprises sequentially activating and deactivating the actuators 50, 50' so as to move the flow tube 14 in an axial direction towards a flapper 20 that covers the valve 12A when the valve is in a closing position, while a method of closing a valve using the ring device comprises deactivating the actuators 50'. The actuators 50, 50' can each comprise a shape memory alloy element. The valve can comprises a flapper 20 that covers the valve 12A when the valve is in a closing position, and deactivation of the actuators 50' can cause movement of the flow tube 14 in an axial direction away from the flapper, such that the flapper, and resultantly the valve, can be in a closing position.

In addition to being able to be used to open and close on/off flow valves 12, 12A, the presently disclosed linear actuation system may also be used to actuate (gradual) flow control valves, such as, for example, subsea control valves, downhole flow control valves, and (subsea) choke valves. However, the (gradual) flow control valve will be lacking the fail-safe spring(s) (and flapper) present in a fail-safe on/off flow valve.

The centering springs 40 of the presently disclosed linear actuation system serve to center the ring 10 about the flow tube 14 such that threading on the interior of the ring is not engaged with the threading 35 on the exterior of the flow tube, causing one or more fail-safe springs 70 to push the flow tube into the closed position and close the safety valve 12A. Accordingly, as the flow control valve is lacking fail-safe spring(s) (and flapper), the presently disclosed linear actuation system, when used to control flow through a (gradual) flow control valve (e.g., a choke valve), can also be lacking centering springs.

As is readily known to those skilled in the art, downhole flow control valves and (subsea) choke valves are used to control fluid flow rate (or downstream system pressure). In particular, such valves enable fluid flow (and pressure) parameters to be changed to suit process or production requirements. Thus, for example, the valves can be closed to increase the resistance to flow through the valves or can be opened to decrease the resistance to flow through the valves. With regard to downhole flow control valves, adjustment of the (rate of) flow through the valve can be achieved by movement of a flow tube having an opening therein, so as to adjust the extent to which the opening is blocked (i.e., covered by the other components of the valve); or conversely, the extent to which fluid is allowed to freely flow through the opening. With regard to choke valves, adjustment of the (rate of) flow through the valve can be achieved by movement of a flow tube surrounding a stationary nozzle containing openings of various sizes, so as to adjust the number and/or size of the openings in a flow path through the valve (i.e., exposing or covering openings in the nozzle by movement of the flow tube).

The (gradual) flow control valves lack the fail-safe spring(s) present in a fail-safe on/off flow valve, because in the (gradual) flow control valves, the flow tube is to be maintained in a desired position (i.e., a desired flow rate), rather than having a mechanism for automatically moving the flow tube towards a closing position of the valve. The flow control valves can also be adjusted such that no flow is allowed through the valve. Thus, a method of adjusting flow rate through a flow control valve using the presently disclosed linear actuation system includes sequentially activating and deactivating the actuators so as to move a flow tube to adjust the flow rate through the valve.

Figure 7:
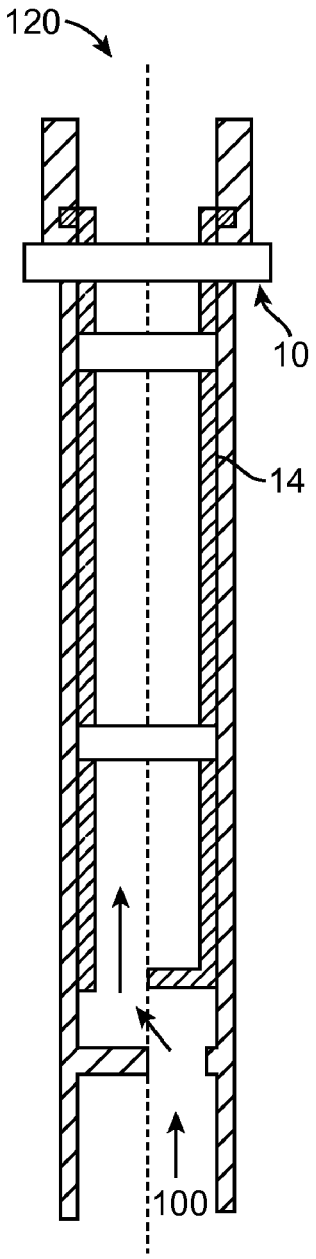
FIG. 7 is a sectional view, in elevation, of a downhole flow control valve, the rate of flow through which can be adjusted via linear actuation via the presently disclosed linear actuation system in the form of a ring.

FIG. 7 is a sectional view, in elevation, of a downhole flow control valve 120, the rate of flow through which can be adjusted via linear actuation via the presently disclosed linear actuation system in the form of a ring 10. In particular, the flow tube 14 of the valve 120 contains an opening at its bottom. The bottom of the valve 120 also contains an opening such that when the flow tube 14 is not in its bottommost position, fluid can flow along a flow path 100 through the valve. In contrast, when the flow tube 14 is at its bottommost position, flow along the flow path 100 is restricted or even completely prevented as the opening at the bottom of the flow tube 14 is blocked by a non-open section of the bottom of the valve and the opening at the bottom of the valve is blocked by a non-open section of the bottom of the flow tube. The flow tube 14 is moved (i.e., from and/or to its bottommost position) by activation and deactivation of the actuators of the ring 10.

Figure 8:
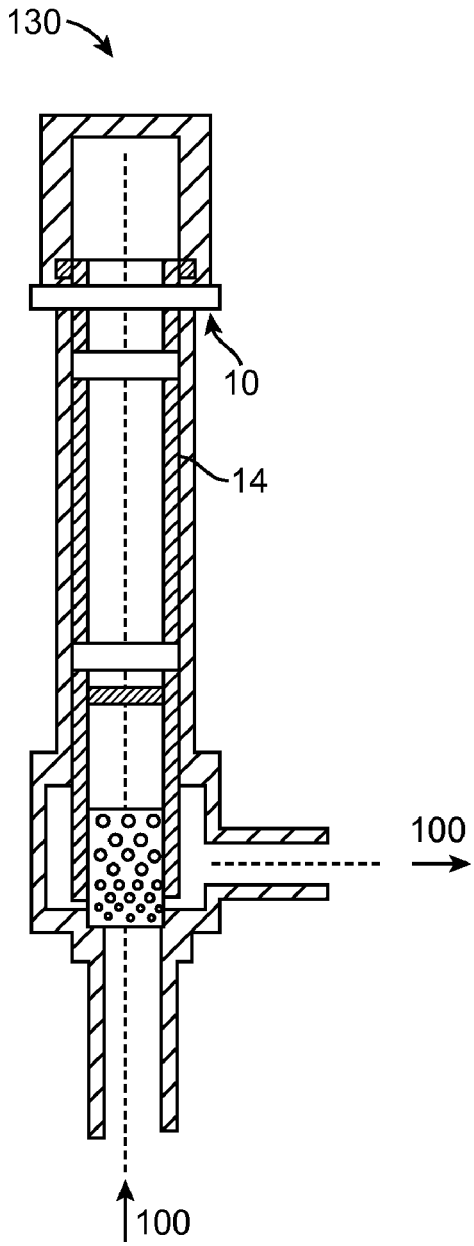
FIG. 8 is a sectional view, in elevation, of a subsea choke valve, the rate of flow through which can be adjusted via linear actuation via the presently disclosed linear actuation system in the form of a ring.

FIG. 8 is a sectional view, in elevation, of a subsea choke valve 130, the rate of flow through which can be adjusted via linear actuation via the presently disclosed linear actuation system in the form of a ring 10. In particular, the flow tube 14 of the valve surrounds a stationary nozzle containing openings of various sizes. Adjustment of the (rate of) flow through the valve is achieved by movement of the flow tube 14 so as to adjust the number and/or size of the openings in a flow path 100 through the valve. Thus, openings in the nozzle are exposed or covered by movement of the flow tube 14, which is achieved by activation and deactivation of the actuators of the ring 10.

While various embodiments have been described, it is to be understood that variations and modifications may be resorted to as will be apparent to those skilled in the art. Such variations and modifications are to be considered within the purview and scope of the claims appended hereto.

Additional descriptions of various embodiments of the present disclosure are made via annotations to the figures, and will be understood to exemplify certain aspects of the present disclosure to those having ordinary skill in the art.

It will be understood from the foregoing description that various modifications and changes may be made in the embodiments of the present disclosure without departing from its true spirit. For example, although the figures illustrate embodiments of the present disclosure in the context of a subsurface safety valve, the concept of applying shape memory alloy operation to effect linear actuation may be implemented in any number of valve apparatus, including various surface, mudline and subsurface valve types and applications. Additionally, shape memory alloy elements may have utility to maintain a valve apparatus in a latched position against a spring-biasing force.

The present description is intended for purposes of illustration only and should not be construed in a limiting sense. The scope of the present disclosure should be determined only by the language of the claims that follow. The term "comprising" within the claims is intended to mean "including at least" such that the recited listing of elements in a claim are an open set or group. Similarly, the terms "containing," "having," and "including" are all intended to mean an open set or group of elements. "A," "an" and other singular terms are intended to include the plural forms thereof unless specifically excluded.

What is claimed is:

1. A device for use in actuating a valve to control the flow of fluids through a flow tube, the device comprising:

a flow tube movable in an axial direction;

a stationary ring surrounding the flow tube, the ring having an inner diameter greater than an outer diameter of the flow tube, wherein an interior of the ring and an exterior of the flow tube have complementary screw threads; and at least three actuators equally circumferentially spaced along an exterior of the ring, wherein when activated one of the actuators induces a screw thread on the interior of the ring to engage a screw thread on the exterior of the flow tube such that the flow tube is moved in an axial direction relative to the ring.

2. The device of claim 1, wherein movement of the flow tube in an axial direction relative to the ring induces movement of the valve from a closing position to an opening position.

3. The device of claim 1, wherein the device further comprises:

centering springs equally circumferentially spaced along an exterior of the ring, wherein when none of the actuators are activated, the centering springs center the ring about the flow tube, and the screw thread on the interior of the ring is not engaged with the screw thread on the exterior of the flow tube.

4. The device of claim 3, wherein the device comprises three actuators and three centering springs.

5. The device of claim 1, wherein the actuators each comprise a hydraulic element to induce engagement by the screw thread on the interior of the ring with the screw thread on the exterior of the flow tube.

6. The device of claim 1, wherein the actuators each comprise a magnetic element to induce engagement of the screw thread on the interior of the ring with the screw thread on the exterior of the flow tube.

7. The device of claim 1, wherein the actuators each comprise a shape memory alloy element to induce engagement of the screw thread on the interior of the ring with the screw thread on the exterior of the flow tube.

8. The device of claim 7, wherein the shape memory alloy comprises an ultra-high temperature shape memory alloy.

9. The device of claim 7, wherein the shape memory alloy element comprises cascading shape memory alloy elements.

10. The device of claim 7, further comprising a control line for conducting energy to the shape memory alloy elements.

11. The device of claim 10, wherein the control line comprises one or more electrically conductive pathways for conducting electrical current across the shape memory alloy elements.

12. The device of claim 10, wherein the energy is provided via an electrical supply selected from a group consisting of AC, DC and high voltage pulse width modulation.

13. The device of claim 1, wherein the valve comprises one or more fail-safe springs.

14. A method of opening a valve using the device of claim 1, the method comprising:

sequentially activating and deactivating the actuators so as to move the flow tube in an axial direction towards a flapper that covers the valve when the valve is in a closing position.

15. The method of claim 14, wherein the actuators each comprise a shape memory alloy element, and further wherein sequentially activating and deactivating the actuators comprises applying energy to and removing energy from the shape memory alloy element of each of the actuators.

16. The method of claim 14, wherein movement of the flow tube in an axial direction towards the flapper forces the flapper, and resultantly the valve, to an opening position.

17. A method of closing a valve using the device of claim 2, the method comprising deactivating the actuators.

18. The method of claim 17, wherein the actuators each comprise a shape memory alloy element.

19. The method of claim 17, wherein the valve comprises a flapper that covers the valve when the valve is in a closing position, and further wherein deactivation of the actuators causes movement of the flow tube in an axial direction away from the flapper, such that the flapper, and resultantly the valve, can be in a closing position.

20. The method of claim 17, wherein the valve comprises one or more fail-safe springs, which push the flow tube into a closing position and close the valve.

21. A method of adjusting flow rate through a flow control valve using the device of claim 1, the method comprising sequentially activating and deactivating the actuators so as to move the flow tube to adjust the flow rate through the valve.

22. The method of claim 21, wherein the actuators each comprise a shape memory alloy element, and further wherein sequentially activating and deactivating the actuators comprises applying energy to and removing energy from the shape memory alloy element of each of the actuators.

* * * * *